US006382397B2

(12) United States Patent
Maeder

(10) Patent No.: US 6,382,397 B2
(45) **Date of Patent: *May 7, 2002**

(54) METHOD AND ARRANGEMENT FOR CONVEYING INDIVIDUALLY HELD PRODUCTS

(75) Inventor: Carl Maeder, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/844,903

(22) Filed: Apr. 27, 2001

Related U.S. Application Data

(63) Continuation of application No. 09/319,855, filed as application No. PCT/CH97/00444 on Nov. 26, 1997, now Pat. No. 6,302,262.

(30) Foreign Application Priority Data

Dec. 13, 1996 (CH) ..... 3069/96

(51) Int. Cl.[7] ..... B65G 47/34
(52) U.S. Cl. ..... 198/465.4; 198/687.1
(58) Field of Search ..... 198/465.1, 465.2, 198/465.4, 687.1, 867.02, 867.03, 867.14, 867.15

(56) References Cited

U.S. PATENT DOCUMENTS

| | | | | | |
|---|---|---|---|---|---|
| 3,006,453 | A | * | 10/1961 | Tonelli | 198/465.4 |
| 3,204,756 | A | * | 9/1965 | Lesch | 198/465.1 |
| 4,465,417 | A | * | 8/1984 | Baumann et al. | 198/465.4 |
| 4,638,906 | A | | 1/1987 | Winiasz | |
| 4,917,227 | A | * | 4/1990 | Matsuo et al. | 198/465.1 |
| 5,769,949 | A | * | 6/1998 | Cienkus et al. | 198/465.4 |
| 5,893,447 | A | * | 4/1999 | Brintazzoli | 198/465.1 |
| 5,927,472 | A | | 7/1999 | Neef et al. | |
| 6,007,064 | A | * | 12/1999 | Cote et al. | 198/465.4 |

FOREIGN PATENT DOCUMENTS

| | | |
|---|---|---|
| DE | 23 40827 A1 | 6/1975 |
| DE | 195 32 281 A1 | 6/1997 |
| DE | 198 00 630 A1 | 7/1999 |
| EP | 0 399 188 A | 11/1990 |
| EP | 0 391 467 B1 | 9/1993 |
| GB | 966402 A | 12/1964 |
| GB | 2 285 426 A | 12/1995 |
| WO | WO 94/00372 A1 | 6/1994 |

* cited by examiner

*Primary Examiner*—Joseph E. Valenza
(74) *Attorney, Agent, or Firm*—Oppedahl & Larson LLP

(57) ABSTRACT

For conveying individually held products (3) in a network of conveying paths (A, B), a holding element (4) is associated with each product (3) and is conveyed together with the product along the entire conveying route for the product (3) which route contains various conveying paths (A, B). Each holding element (4) comprises at least one first coupling part (1) for being coupled to a conveying element being movable along a given conveying path (A, B) and comprising a second coupling parts (2) or for being coupled to guides extending along the conveying paths. In transfer areas (U) in which products and holding means are transferred from one conveying path to another conveying path control means are provided for uncoupling holding elements (4) from conveying elements or guides of a first conveying path (A) and for coupling holding elements (4) to conveying elements or guides of a second conveying path (B).

20 Claims, 9 Drawing Sheets

METHOD AND ARRANGEMENT FOR CONVEYING INDIVIDUALLY HELD PRODUCTS

This is a continuation of application Ser. No. 09/319,855, filed Aug. 13, 1999 now U.S. Pat. No. 6,302,262 which is the National Stage of PCT/CH97/00444 filed Nov. 26, 1997.

The invention is in the field of conveying technology and relates to a method for conveying individually held products according to the preamble of the first independent claim, as well as to an arrangement for performing the method according to the preamble of the corresponding independent claim.

The products to be considered hereinafter are held individually and are conveyed substantially continuously through a network of conveying paths on optionally individual routes. By this conveying operation the products are e.g. brought from a manufacturing process to stations in which they are individually further processed, or they are conveyed from one processing station to another or through processing stations in which they are processed during continuous conveyance. An example for products to be handled in this way are printed products which, coming from the printing press, are further processed and rendered ready for dispatch by the most varied processing stations.

It is known to individually convey printed products, in that each of the products is held by a gripper or some other suitable holding means. For this purpose e.g. a plurality of grippers or holding means are fixed to a transport chain and the chain is driven and guided in such a way that the products held by the grippers or holding means are conveyed in a predetermined manner over a predetermined conveying path. At points where all or individual products of such a product stream are to be passed from a first to a second conveying path, the two conveying paths are arranged relative to one another in such a way that the products can be taken over by the holding means of the second conveying path and can be released by the holding means of the first conveying path, normally without interruption of the continuous conveyance. For such operation, at the transfer point, control means are provided for both the participating conveying paths, the control means controlling activation of all or individual ones of the holding means (bringing them into a holding configuration) or deactivation (bringing them from the holding configuration into a non-holding configuration).

Also known are arrangements in which the holding means being movable along a conveying path are interconnected such that the spacings between them are variable. In the same manner as described above, transfer points of such arrangements are equipped with control means for activating or deactivating the holding means and such arrangements additionally comprise means for synchronizing the releasing and the taking-over holding means.

The above-described arrangements for conveying articles are particularly suitable for product streams, which are conveyed over longer conveying paths with a substantially unchanged product sequence. The arrangements are robust and easily operable even for very high conveying capacities and it is possible to implement the return of the holding means on a simple return path without any specific control.

However, if the products to be conveyed are easily mechanically damaged and have only a limited inherent stability, complicated guidance means have to be provided at the transfer points to ensure that the products are not damaged on being transferred and it is important to very precisely synchronize the movements of releasing holding means and of the taking-over holding means at the transfer point. Thereby, the guidance means and the synchronization must be adapted to each product type to be conveyed (product format). For there reasons conveying systems of this type are advantageously designed with a minimum number of transfer points.

Conveying systems comprising independent, i.e. non-interconnected holding means which are movable along conveying paths are known also. Such arrangements are particularly suitable for conveying methods with product-specific conveying routes whereby for guiding the movement of the holding means guidance systems with branching points and return points are provided, the switch points being controllable in a product-dependent manner. Such conveying systems can be operated in a very flexible manner, but tend to be complicated regarding control and driving means. Controllable guidance systems must also be provided for the return of the holding means.

The object of the invention is to provide a method for conveying individually held products whereby the method is to combine the advantages of the above-described systems, but largely eliminating their disadvantages. In particular, the method is to be substantially independent of shape variations with respect to the products to be conveyed. The method is to be usable for very high conveying capacities and is to be better adaptable than known methods of the same type to the most varied conveying functions in different areas through which the products are to be conveyed. A further object of the invention is to provide an arrangement for carrying out the method, said arrangement being easily adaptable to the most varied, local conveying functions and also easily extendable.

This object is achieved by the method and the arrangement, as defined in the claims.

The inventive method is based on associating a holding element with each product to be conveyed, the holding element holding the product in a clearly defined manner and covering together with the product the entire conveying route intended for the product, said route comprising a series of conveying paths. For conveying, the holding elements are coupled to parts movable along a specific conveying path or to guides extending along a specific conveying path.

A network of clearly defined conveying paths is provided, together with a plurality of holding elements. Each of the holding elements has at least one first coupling part, with the aid of which it can be coupled to a second coupling part, each second coupling part being associated with a specific conveying path and being movable along this path. According to another method variant, the holding elements are coupled to guides extending along a conveying path with the aid of the first coupling parts.

For conveying it along a conveying path, a product is held by a holding element and the holding element is coupled to a second coupling part with the aid of the first coupling part, the second coupling part being movable along the conveying path. It is possible also to couple the holding element with the aid of the first coupling part to a guide extending along the conveying path. The coupling part, the conveying element on which the coupling part is located, or the holding element is driven along the conveying path by suitable means. In transfer areas, i.e. at points where the product is passed from one conveying path to another conveying path, the holding element is uncoupled from the second coupling part movable on the first conveying path or from the corresponding guide and it is coupled to a second coupling part movable on the second conveying path or to a corresponding guide, thereby of a stream of products either all products are transferred or specific products only.

The advantage of the inventive method is the fact that the products to be conveyed have to be gripped or grasped only once. This significantly reduces the damage risk and renders the method substantially independent of the precise product shape. In addition, the second coupling parts movable on the conveying paths are movable in very different ways depending on the conveying function of a specific conveying path within a given network of conveying paths. The second coupling parts can e.g. be arranged equidistantly on conveying chains. If holding elements are coupled to such a conveying chain, their function corresponds to a known conveying chain of the type described hereinbefore. The second coupling parts can also be positioned on links of chains having variable link spacings or they can be arranged on completely independently movable conveying elements. Corresponding drive means can be designed and positioned depending on the nature of the movement of the second coupling parts along a specific conveying path.

In addition to the conveying paths with second coupling parts movable thereon, in an arrangement according to the invention there may also be conveying paths on which the holding elements can be moved without coupling, e.g. in that their first coupling parts slide in correspondingly designed guides, e.g. being driven by the force of gravity. Such additional conveying paths are particularly suitable for non-continuous conveying, e.g. for buffer paths and return paths.

A further advantage of the method and arrangement according to the invention is the fact that in processes in which it is advantageous to individually identify the products, suitable identification means do not have to be located on the actual products, but instead can be carried by the holding elements and therefore, do not leave the conveying system. Such identification means are e.g. electronic units which are writable and readable without contact.

A number of exemplified embodiments of the method and arrangement according to the invention and of embodiments of parts thereof are described in greater detail in connection with the attached Figures, wherein.

Figure 1:
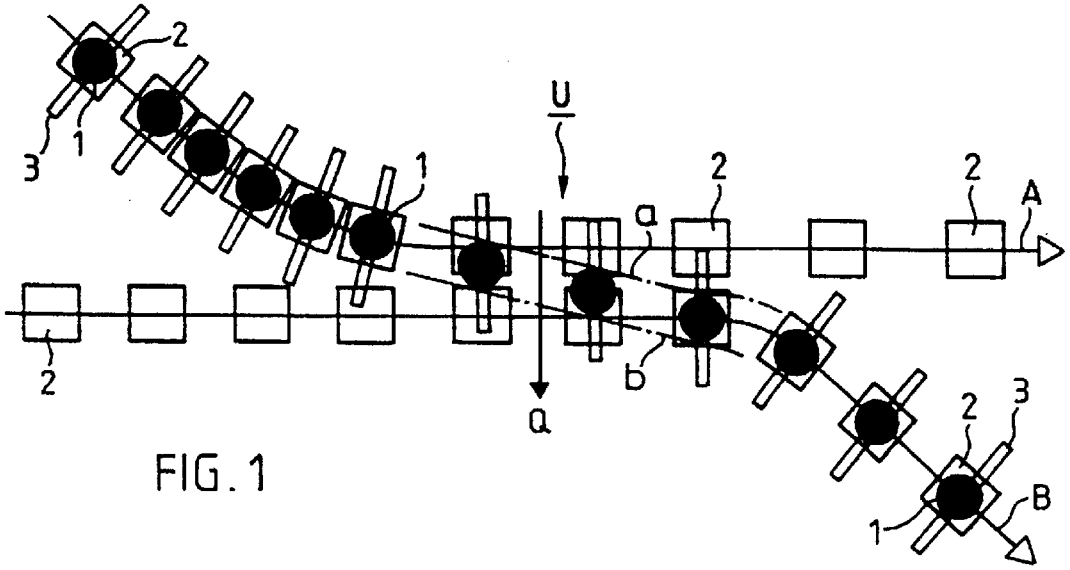
FIG. 1 shows a transfer area as an illustration of a first, exemplified embodiment of the inventive method variant.

FIG. 1 illustrates a first, exemplified embodiment of the inventive method by showing in a schematic manner a very limited network having only two conveying paths A and B which are shown in a transfer area U and its immediate vicinity. The two conveying paths are diagrammatically represented by arrowed lines (conveying directions). Second coupling parts 2 are movable on the two conveying paths and are diagrammatically represented as white squares. First coupling parts 1 are diagrammatically represented as black circles. In each case one first coupling part 1 is located on a not shown holding element, which holds a product 3. The product is e.g. a printed product, i.e. a newspaper, magazine, brochure or intermediate product for one of the aforementioned products. FIG. 1 shows the bound or folded backs of the products.

The representation of FIG. 1 can be understood as a birds eye view, i.e. the conveying paths A and B, the coupling parts 1 and 2 and the holding elements are arranged above The products 3 which are conveyed in suspended manner. However, the representation can equally well be understood as a side view, i.e. the products 3 are held laterally, the conveying path A arriving from above and the conveying path B passing away downwards. Mixed forms car also be easily conceived.

On the conveying path B the second coupling parts 2 having constant mutual spacings are moved e.g. arranged on articulated interconnected chain links. On the conveying path A the second coupling parts 2 do not have constant mutual spacings, i.e. they are for example placed on loosely interconnected conveying elements or on individual conveying elements. For this reason, for the transfer area U synchronizing means (not shown) must be provided for synchronizing the second coupling parts 2 on the conveying path A with the second coupling parts 2 on the conveying path B at least in the transfer area U or for clocking the second coupling parts of the conveying path A into the transfer area. For transferring holding elements from a chain with equidistant chain links to another chain having links with the same spacings, the two chain drives must be correspondingly synchronized.

On the supply side (to the left of FIG. 1) to the transfer area U, the holding elements with the first coupling parts 1 are coupled to the second coupling parts 2 movable on the conveying path A. In the transfer area, in which the second coupling parts 2 of the two conveying paths A and B are moved in parallel and synchronized with one another, each first coupling part 1 is uncoupled from the corresponding, second coupling part 2 of the conveying path A, is moved at right angles to the conveying direction (arrow Q) and is coupled to a second coupling part 2 of the conveying path B. On the conveying away side (to the right in FIG. 1) from the transfer area U, the holding elements and first coupling parts 1 are coupled to second coupling parts 2 on the conveying path B and are conveyed away thereon.

Besides synchronizing means for synchronization of the second coupling parts 2 of the two conveying paths A and B, the transfer area U needs means for moving the holding elements and first coupling parts 1 at right angles to the conveying direction (arrow Q), e.g. corresponding cams, as indicated by the dot-dash lines a and b. For a specific transfer, in which only specific and not all the holding elements with products are to be transferred, the means for the transverse movement must be made correspondingly controllable. In corresponding arrangements gravity can also be used as a transverse movement means.

Advantageously, there are also locking means for locking in each case two coupled coupling parts 1 and 2 together. Corresponding control means must be provided in the transfer area U for activating or deactivating the locking means.

Figure 2:
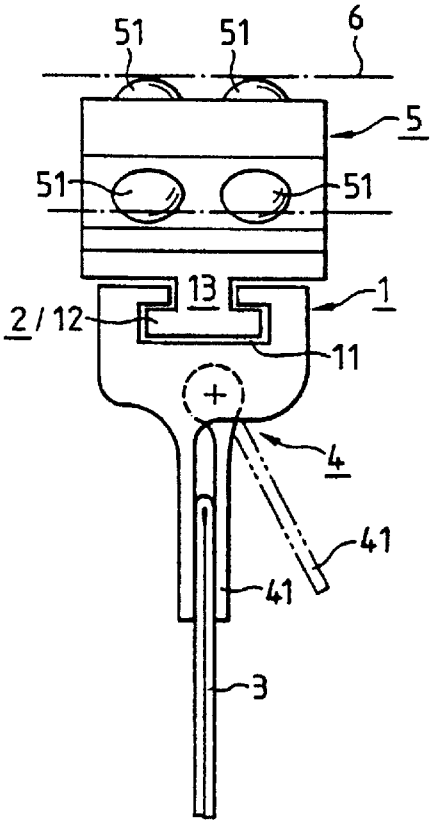
FIGS. 2 to 4 show exemplified holding elements for being used in the embodiment of the inventive method according to FIG. 1, the elements comprising first coupling parts cooperating with second coupling parts.
Figure 3:
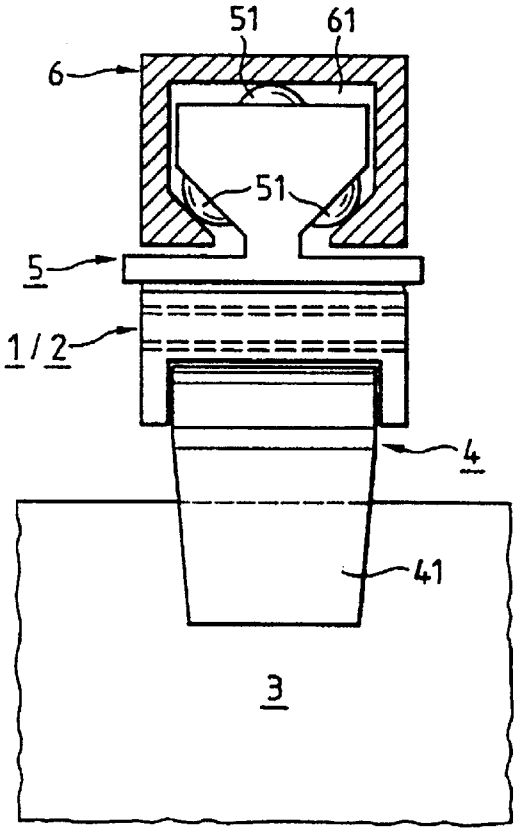

FIGS. 2 and 3 show an exemplified embodiment of a holding element with a first coupling part 1 and of a conveying element 5 being movable in a guide 6 (clearly defined conveying path) and on which is located a second coupling part 2. The holding element 4 and the conveying element 5 are shown in FIG. 2 in a viewing direction at right angles to the conveying direction and in FIG. 3 with a viewing direction parallel to the conveying direction. Holding elements 4 and conveying elements 5 equipped according to FIGS. 2 and 3 are suitable for the embodiment of the inventive method according to FIG. 1.

The pair of cooperating coupling parts ½ shown in FIGS. 2 and 3 comprises a part with a groove 11 narrowing towards the outside and a comb 12 having a narrowed neck area 13. Groove 11 and comb 12 have cross-sections matched to one another and are oriented substantially at right angles to the conveying direction at least in a taking-over area, such that the comb 12 can be moved out of the groove 11 at about right angles to the conveying direction. In the represented embodiment the groove 11 is located on the holding element 4 and the comb 12 on the conveying element 5, but this arrangement can obviously be reversed.

The holding element 4 e.g. comprises a gripper 41 for gripping and holding a printed product 3. Such grippers are generally known, e.g. from the publications CH-569197 or U.S. Pat. No. 3,948,551. The conveying element 5 e.g. comprises two groups of in each case three balls, with the aid of which it rolls in a corresponding guide channel 61. Such conveying elements 5 are described in the publication EP-387318 or U.S. Pat. No. 5,074,678.

In a transfer area, two guide channels 61 extend parallel to one another and the conveying elements 5 are synchronized in such a way that they are conveyed in pairs of conveying elements with aligned combs 12 through the transfer area. In the transfer area, the spacing between the guide channels 61 is such that the spacing between the aligned combs 12 of two synchronously moved conveying elements 5 is smaller than the length of a groove 11 of a holding element 4. Using suitable means, the holding element 4 positioned in comb 12 of one conveying element can be moved onto the aligned comb 12 of the other conveying element 5. Such means for transverse movement are either designed for moving all the holding elements conveyed through the transfer area or for moving specific ones of them in a controlled manner. These means are e.g. cams or magnetic systems being particularly suitable as controlled movement means.

Figure 4:
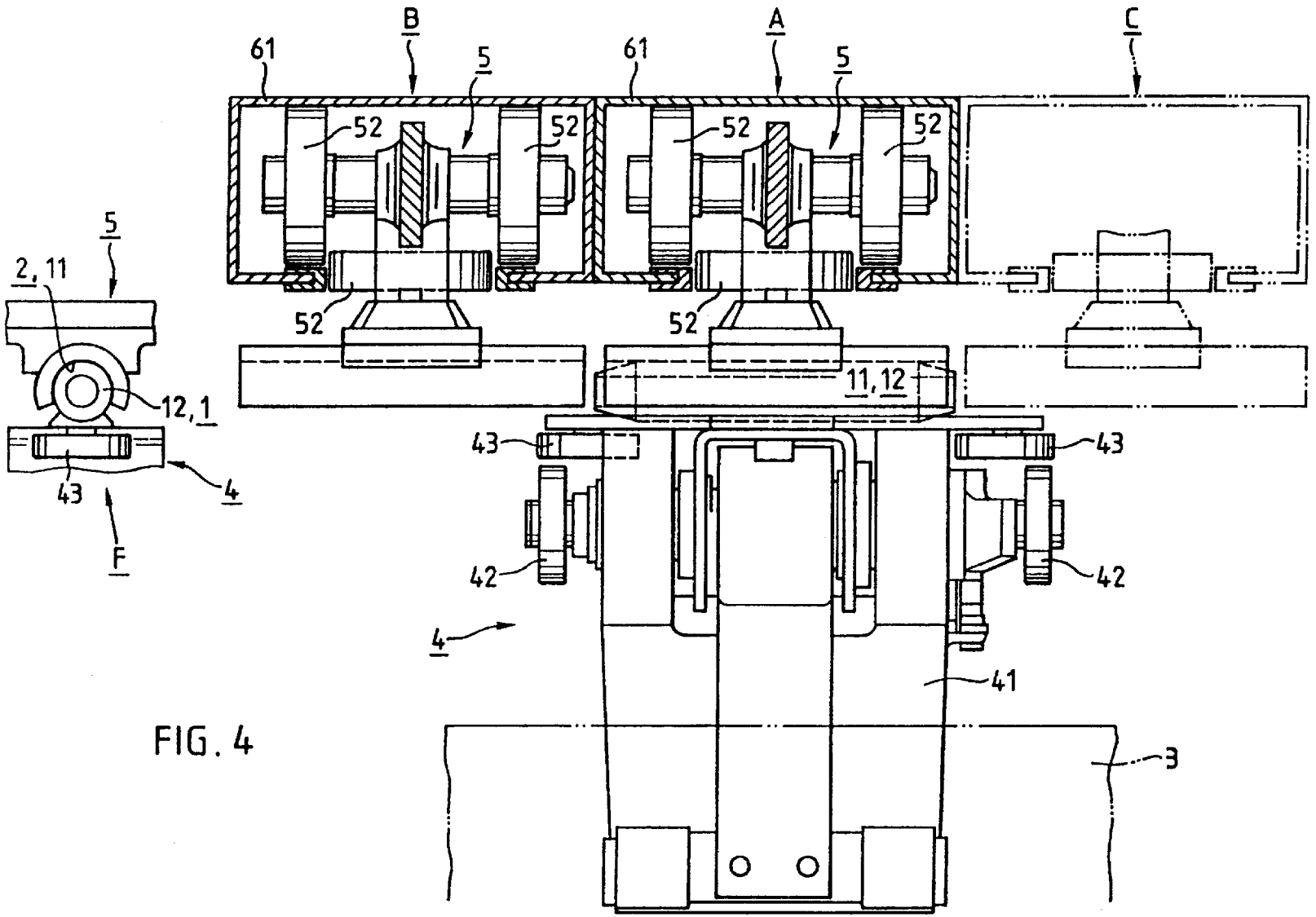

FIG. 4 shows a further embodiment of a transfer area with three conveying paths A, B and C, viewed parallel to the conveying direction. It illustrates a further embodiment of holding elements 4 and conveying elements 5, which can be coupled together via a pair of coupling parts 1 and 2. The holding element 4 once again has a gripper 41 for gripping and holding a product 3. The gripper 41 is activated (for gripping) or deactivated (for releasing) by means of control rollers 42. The conveying element 5 is a link of a link chain and rolls on rollers 52 in a guide channel 61.

As the first coupling part 1, a comb 12 is provided on the holding element 4 and as the second coupling part 2, a groove 11 is provided on the conveying element 5 (coupling parts interchanged compared with the embodiment of FIGS. 2 and 3). As can be gathered from the detail view F (at right angles to the conveying direction), said groove 11 comprises a tubular segment and the head part of the comb 12 comprises a tube, whose external diameter is matched to the internal diameter of the tubular segment.

The holding element 4 also has control rollers 43, which roll on correspondingly positioned, cams (not shown) for moving the comb 12 from the groove 11 of one conveying element 5 into the groove of another conveying element.

Figure 5:
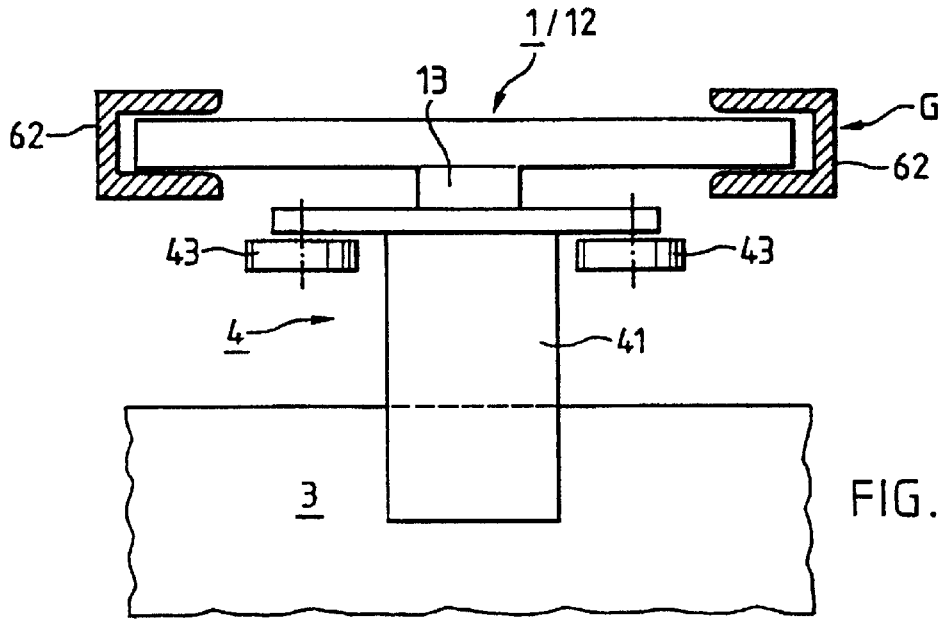
FIG. 5 shows an example of an additional conveying path for holding elements according to FIG. 2.

FIG. 5 shows a holding element 4 being movable along an additional conveying path G without second coupling parts. The holding element 4 essentially corresponds to the holding element of FIG. 4 and is equipped with control rollers 43 and with a comb 12 constituting the first coupling part 1. The comb 12 used for coupling to a second coupling part has a neck area 13, which only extends over a central portion of the comb length, such that the lateral areas of the comb 12 are free tube ends. With said free tube ends, the holding element 4 can be bilaterally guided in sliding manner in corresponding, e.g. U-shaped guide rails 62 representing a further conveying path (e.g. buffer path) of an inventive conveying arrangement. A return path for empty holding elements can also be implemented in such a way, the holding elements advantageously being driven by gravity or by other, e.g. impacting drive means.

Figure 6:
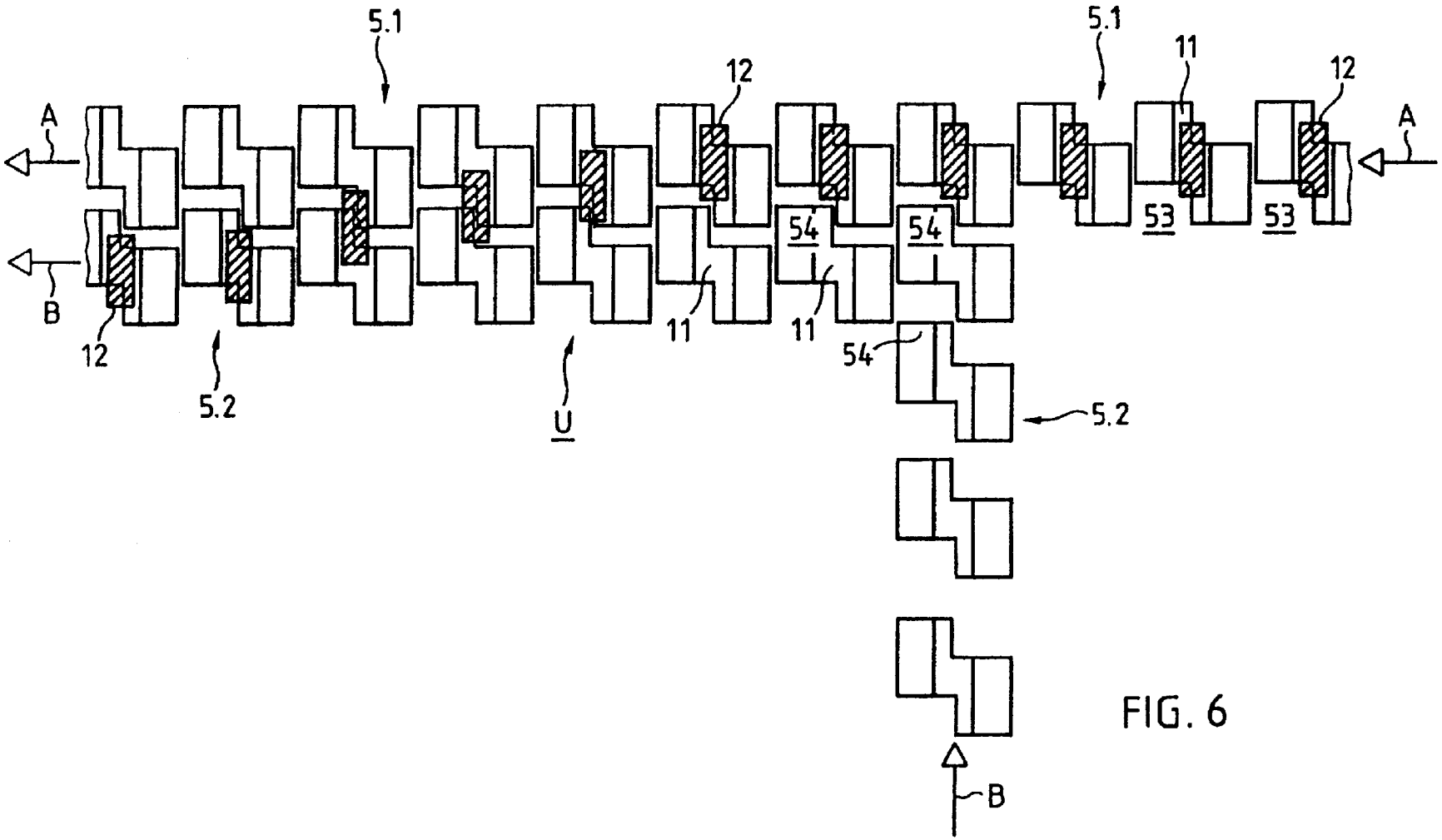
FIG. 6 shows as an example the synchronization of conveying means in a transfer area.

FIG. 6 diagrammatically shows a further transfer area U with two conveying paths A and B. In said transfer area once again holding elements, whereof only the first coupling parts in the form of combs 12 are shown, are displaceable in corresponding grooves 11 of conveying elements 5.1 belonging to conveying path A and in grooves 11 of conveying elements 5.2 belonging to conveying path B. The grooves 11 and the combs 12 are oriented substantially at right angles to the conveying direction, at least in the transfer area U.

The conveying elements 5.1 being movable on the conveying path A are interconnected to form a chain, so that their spacings are invariable. The conveying elements 5.2 are free, i.e. non-interconnected elements. The conveying elements 5.1 and 5.2 are designed for self-synchronization. For this purpose the chain of the conveying elements 5.1 has concave docking points 53 between the conveying elements. Into the concave docking points 53 fit convex docking points 54 of the conveying elements 5.2. The free conveying elements 5.2 are now guided against the chain of conveying elements 5.1 in such a way that in each case a convex docking point 54 of a free conveying element 5.2 is docked by a positive engagement in a concave docking point 53 between two linked conveying elements 5.1. Docked in this way, the free conveying elements 5.2 are conveyed via the linked and driven conveying elements 5.1 at least through the transfer area U, whereby holding elements e.g. of the linked conveying elements 5.1 are pushed onto the free conveying elements 5.2, as shown in FIG. 6.

Figure 7:
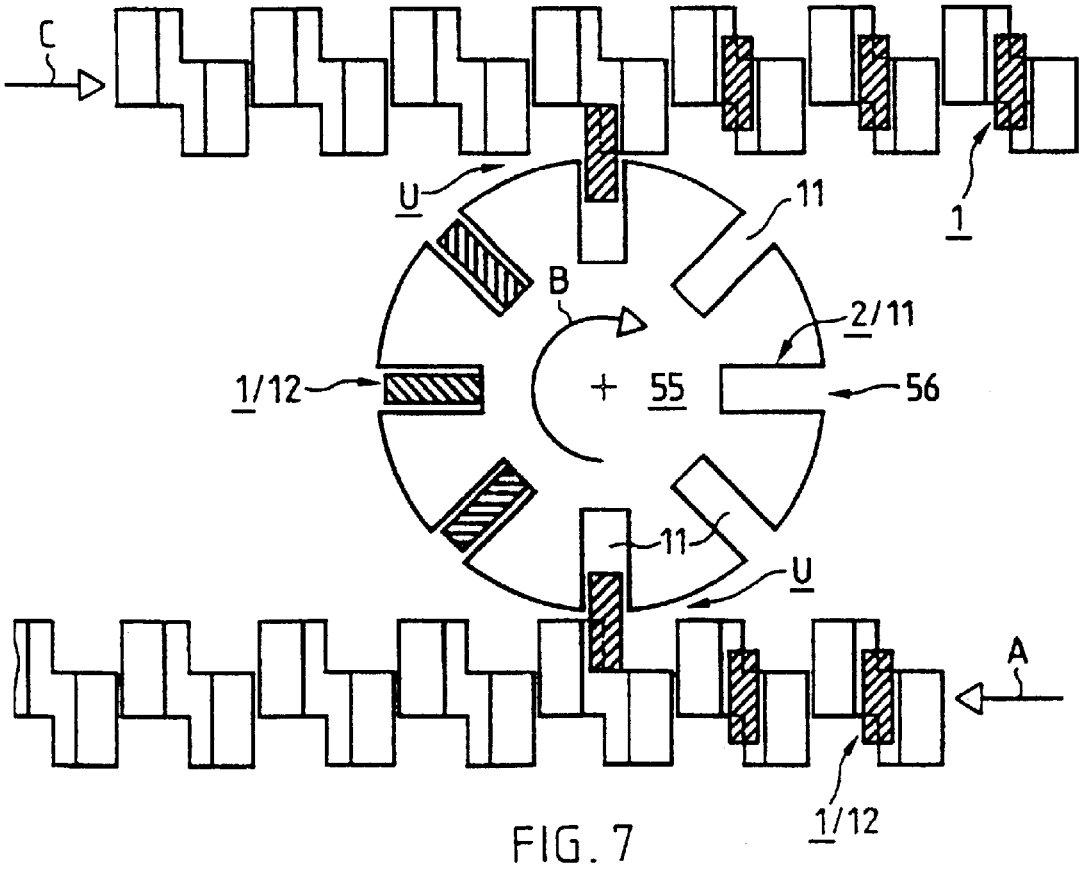
FIGS. 7 to 10 show further transfer areas operated according to the embodiment of the inventive method as shown in FIG. 1.

FIG. 7 illustrates a further example of an arrangement for carrying out the embodiment of the inventive method according to FIG. 1. It shows part of a network of conveying paths, which part comprises parts of three conveying paths A, B and C in two transfer areas U. The conveying elements of the conveying paths A and C correspond to the conveying elements described in conjunction with FIG. 6. The conveying elements of conveying path C are cells 56 located on a rotary wheel 55 and comprise for second coupling parts 2 e.g. a groove 11 into which first coupling parts 1, e.g. combs 12 are inserted.

Figure 8:
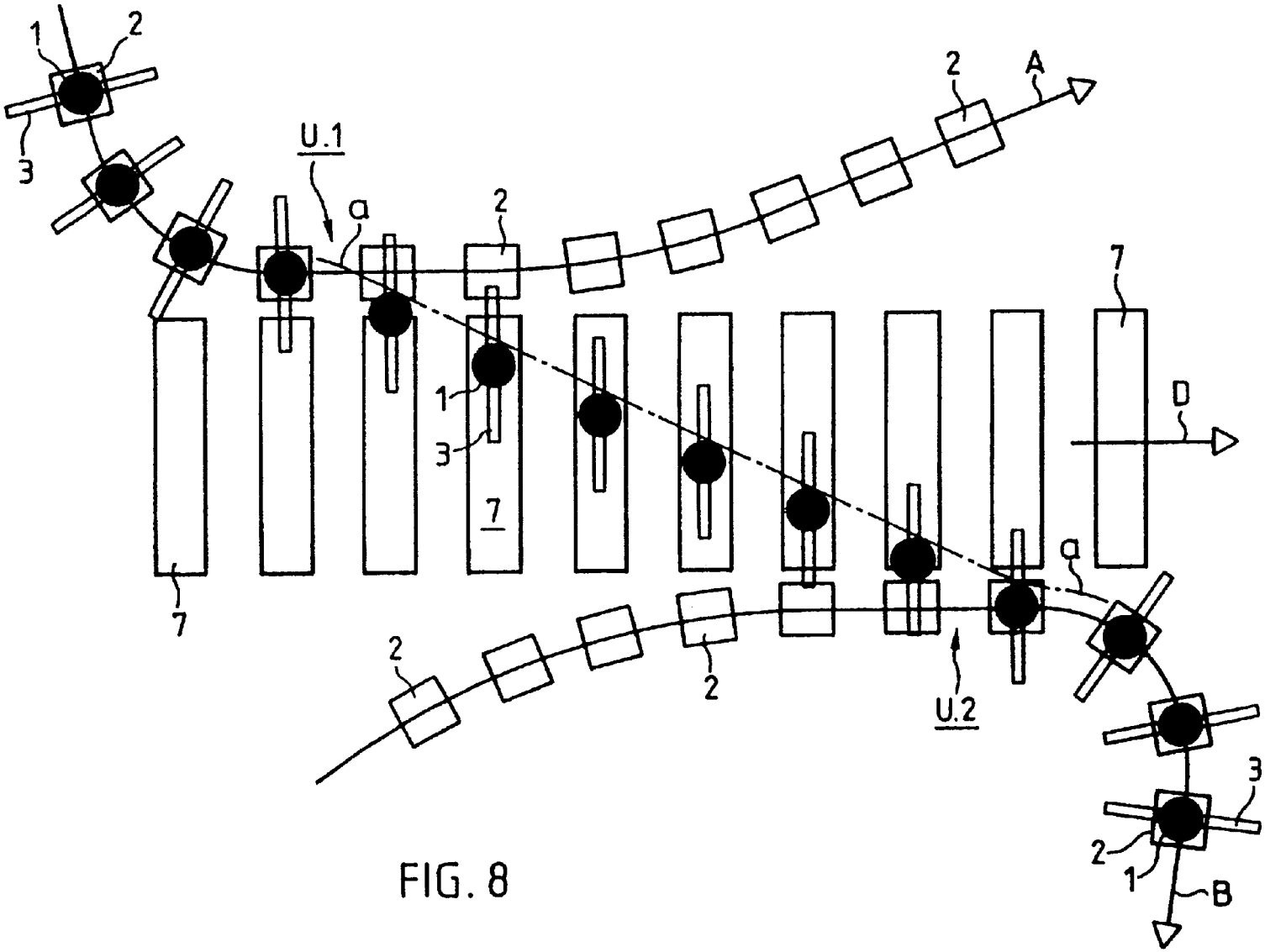

FIG. 8 shows a further embodiment of a transfer area, which is operated substantially in accordance with the embodiment of the inventive method as shown in FIG. 1. Once again there are two conveying paths A and B on which second coupling parts 2 (white squares) are movable. Between the two conveying paths A and B are provided a plurality of transverse conveying elements 7 (diagrammatically represented by white rectangles), which are movable in synchronization with the conveying elements of conveying paths A and B along a third conveying path D. In a first transfer U.1, the holding elements (only first coupling parts 1 shown as black circles) with the products 3 are in each case transferred to a transverse conveying element 7 by uncoupling the first coupling part 1 of the holding element from the coupling part 2 of the conveying path A and by pushing the holding element onto the transverse conveying element 7. The transverse conveying element 7 differs from the conveying element in that, in place of a second coupling part 2, it has a guide. The first coupling part 1 of the holding element is positionable on this guide by being pushed substantially at right angles to the general conveying direction.

On the other side of the transverse conveying element 7 the first coupling part 1 of the holding element is coupled in a second transfer U.2 to a second coupling part 2 of the conveying path B and is conveyed away along the conveying path B.

The drive for the transverse conveying within the transverse conveying element 7 can be a cam (diagrammatically represented by the dot-dash line a), which can also control the two transfers U.1 and U.2. It is also conceivable for the transverse conveying element 7 to be equipped with their own, corresponding drive means for the transverse conveying of the holding elements. As shown in FIG. 8, the conveying of holding means and products in the transverse conveying element 7 can be continuous or contain stops.

Figure 9:
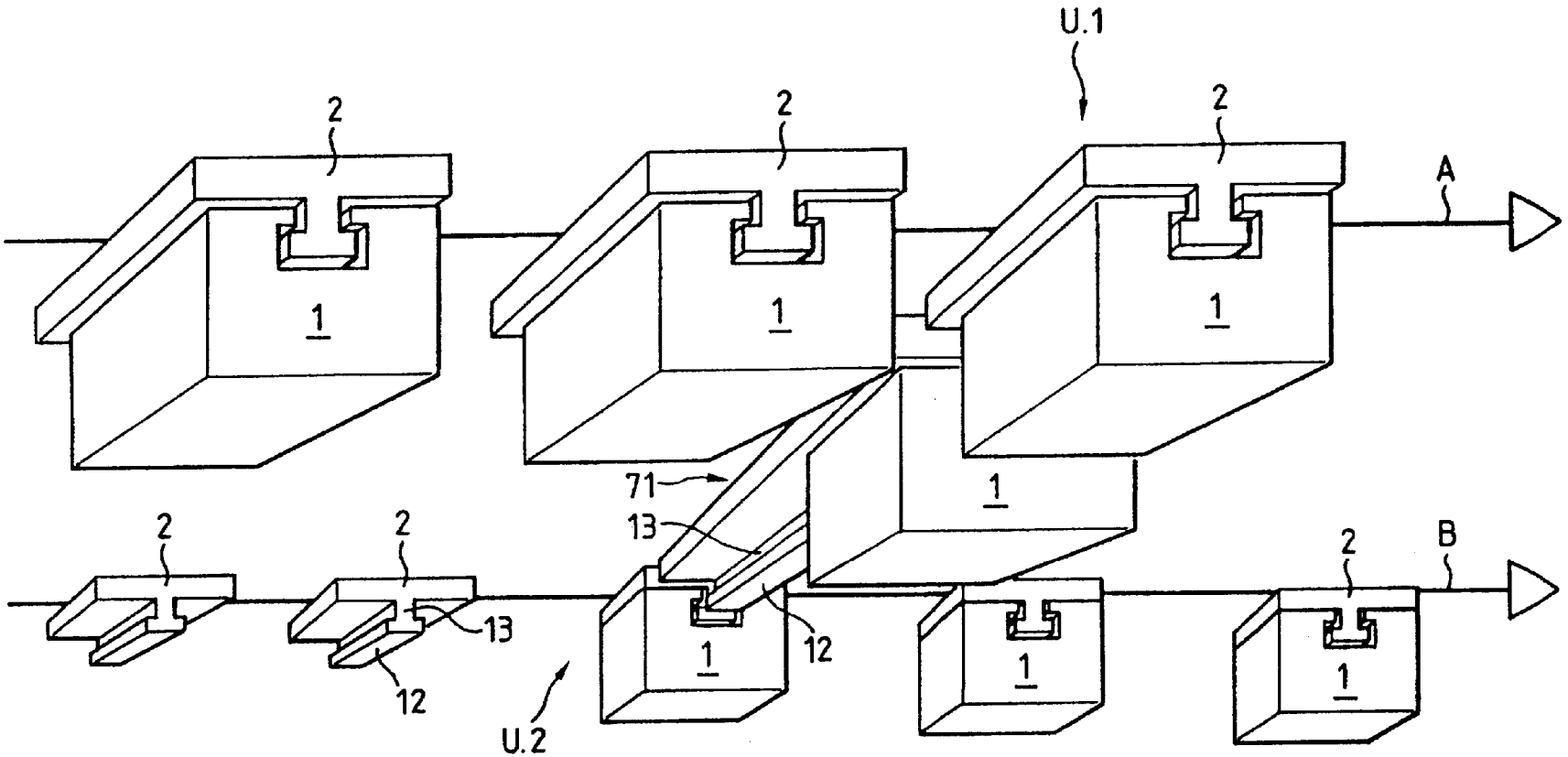

FIG. 9 shows in a three-dimensional representation the same transfer area as shown in FIG. 8. Only first coupling parts 1, second coupling parts 2 of conveying paths A and B and a transverse guide 71 of a transverse conveying element are shown. The coupling parts 1 and 2 correspond to the coupling parts shown in FIGS. 2 and 3. The transverse guide 71 of the transverse conveying element is essentially a comb 12 with a narrowed neck area 13 having the same cross-section as the comb 12 of the second coupling part 2, but is normally longer than the latter.

Figure 10:
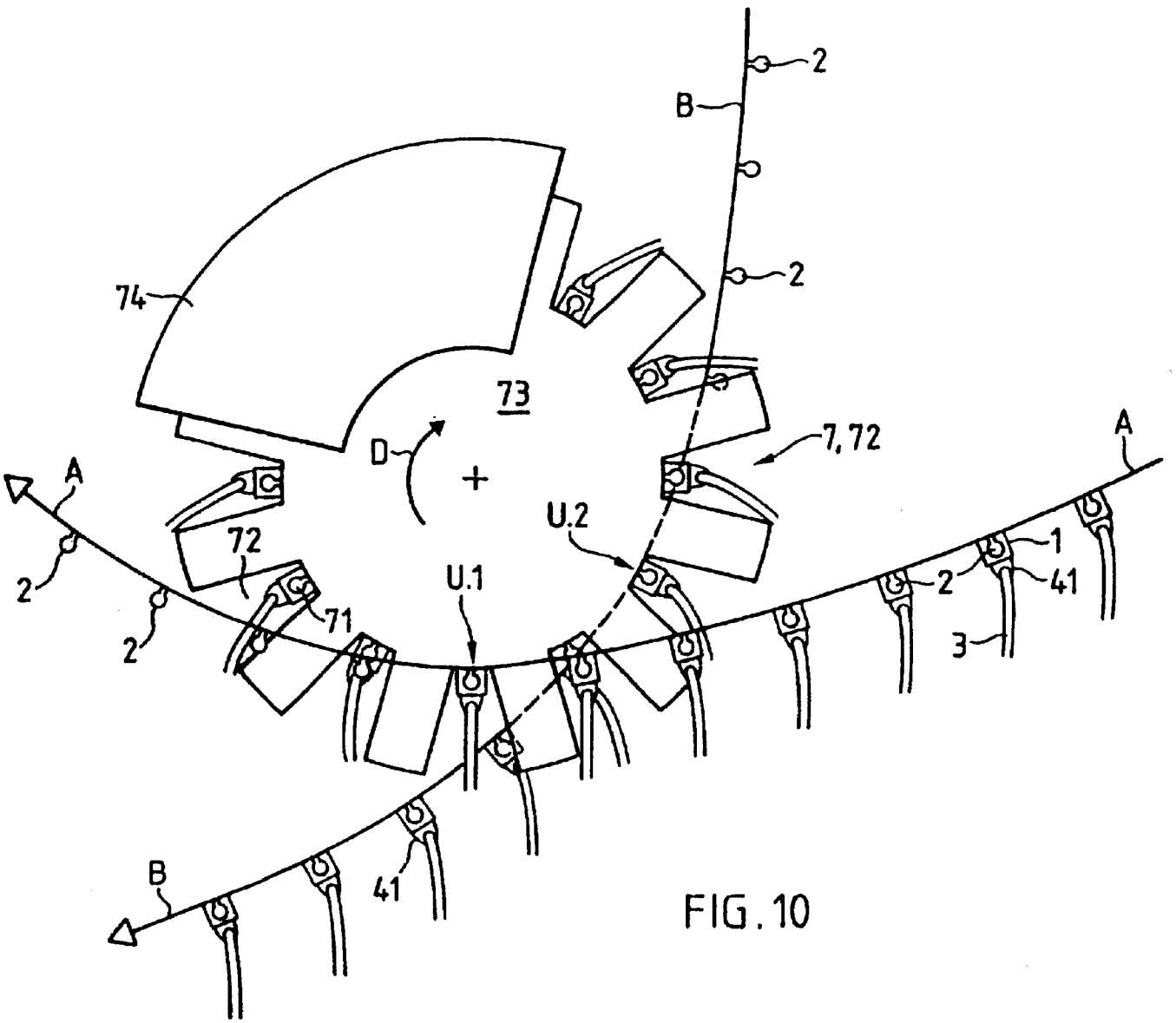

FIG. 10 diagrammatically shows an application of the transfer area with transverse conveying, as has already been described in conjunction with FIGS. 8 and 9. The transverse conveying elements 7 are in this case axially running compartments 72 of a processing drum 73. The product-supplying conveying path A, the drum 73 and the product-removing conveying path B are positioned behind each other along a line at right angles to the paper plane of FIG. 10, so that the transverse conveying is substantially perpendicular to the paper plane and the first transfer U. 1 is performed in a front, axial area of the drum 73 and the second transfer U.2 in a rear, axial area of the drum.

The products 3, held by grippers 41, coupled by means of first coupling parts 1 to second coupling parts 2, are conveyed along the conveying path A. In a first transfer U.1 on one face of the drum 73, the first coupling parts 1 are uncoupled from the second coupling parts 2 and the products, with holding elements (grippers 41 and first coupling part 1) are pushed into in each case one compartment 72 of the drum 73 or each first coupling part 1 is pushed onto a transverse guide 71, which is located on the base of each compartment 72. During the rotation of the drum (arrow D), the holding elements are e.g. moved in the axial direction of the drum 73 along the transverse guide 71 and the products 3 are e.g. conveyed through and processed in a processing station 74.

Then, in a second transfer U.2 on the other face of the drum 73, the processed products, held by the grippers 41 are coupled by means of the first coupling parts 1 to second coupling parts of the conveying path B and are conveyed away.

Arrangements like the one shown in FIG. 10, in which the products are processed during transverse conveying, are also conceivable with rotary systems or other similar means in place of the drum 73.

Figure 11:
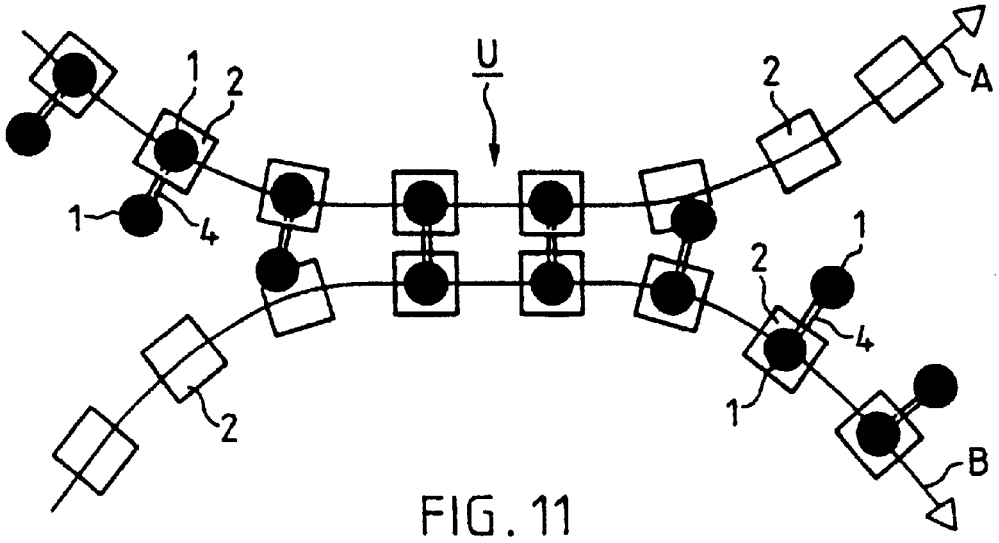
FIG. 11 shows a transfer area operated according to a further exemplified embodiment of the inventive method.

FIG. 11 illustrates a further, exemplified embodiment of the inventive method by showing a transfer area U with two conveying paths A and B. This embodiment differs from the one shown in FIGS. 1 and 8 in that the holding elements 4 have in each case at least two, first coupling parts 1 and for conveying purposes one of the first coupling parts is coupled to one second coupling part. As can be seen in FIG. 11, using such a method there is no need for a transverse movement Q of the holding elements 4 on transfer.

However, if there is to be a transverse conveying, e.g. for processing in accordance with FIGS. 8 to 10, the holding elements must be additionally equipped with the coupling parts necessary for transverse conveying, i.e. holding elements must be designed in such a way that they can be used both according to the first embodiment of the inventive method (FIG. 1) and according to the second embodiment (FIG. 11).

Figure 12:
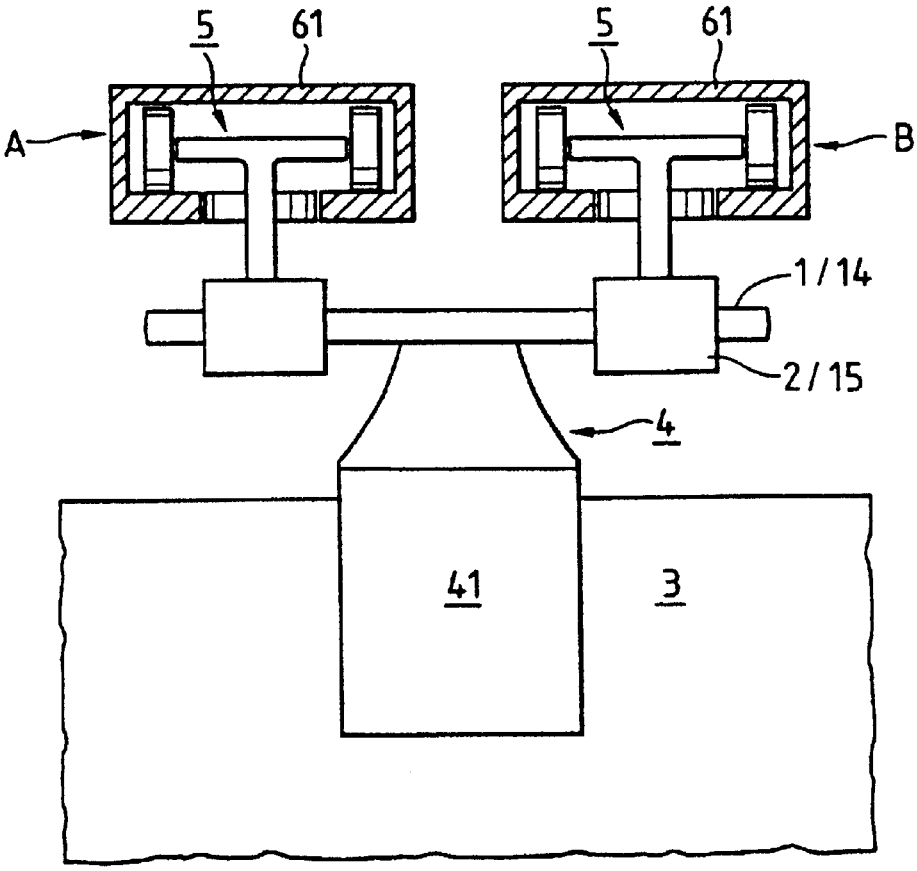
FIGS. 12 & 13 show examples of holding elements with first coupling parts and corresponding, second coupling parts to be used in the embodiment of the inventive method as shown in FIG. 11.

FIG. 12 shows in a viewing direction parallel to the conveying direction a transfer area in which, according to the second embodiment of the inventive method (FIG. 11), holding elements 4 with products 3 are transferred from a conveying path A to a conveying path B or vice versa.

The first coupling parts 1, whereof each holding element 4 has two, are connecting pieces 14, arranged on the holding element 4 and oriented in opposing directions. The second coupling parts 2 arranged on conveying elements 5 being movable along the conveying paths are coupling grippers 15 designed for gripping the connecting pieces 14.

In the transfer area there are control means for activating or deactivating the coupling grippers 15. The expert knows grippers for holding products and control means for activating or deactivating such grippers. Such grippers have to be correspondingly adapted for functioning as second coupling parts 2 (coupling grippers).

In place of connecting pieces 14 and coupling grippers 15, the first coupling parts 1 and the second coupling parts 2 for the embodiment of the inventive method according to FIG. 11 can be constituted by the most varied, known coupling parts, which are correspondingly controllable in a transfer area.

Figure 13:
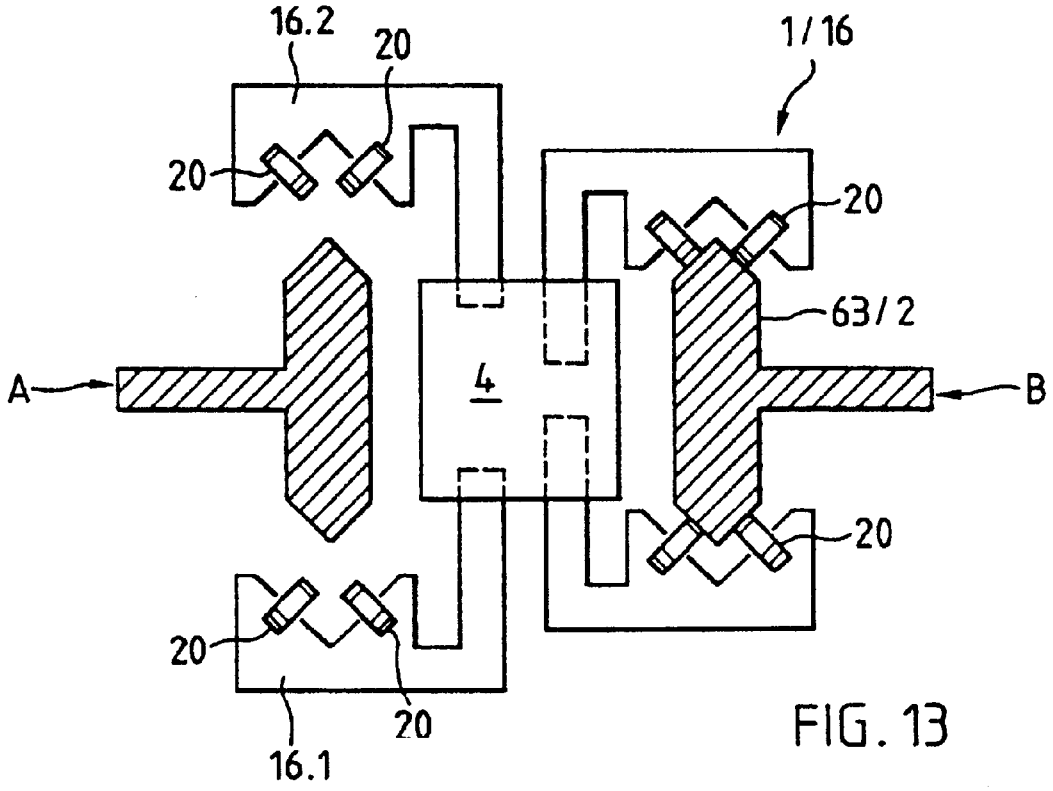

FIG. 13 shows a further embodiment of first and second coupling parts for the embodiment of the inventive method according to FIG. 11. Once again, the Figure shows a transfer area with two conveying paths A and B (viewed parallel to the conveying direction) being each defined by a guide 63 extending along the conveying path. The first coupling parts 1 of the holding elements 4 are runners, which can be coupled to the guide rail and slide or roll thereon. The guide 63 not only defines the conveying path, but simultaneously constitutes a second coupling part 2 for each holding element 4 to be conveyed along the conveying path. At each point of the conveying path a different area of the guide serves as the second coupling part and consequently the coupling is movable along the conveying path.

Each holding element 4 has two, first coupling parts 1 in the form of runners 16 couplable to the guide 63. In the represented case the runners 16 comprise two runner parts 16.1 and 16.2, which can be brought into a state closed around the guide 63 and into an open state, using suitable control means and optionally resetting means. The runners 16 roll, e.g. as shown, on rollers 20 on the guide 63 or they slide thereon.

For further embodiments it is possible that the guide 63 is simultaneously a drive means, i.e. is moved along the conveying path. In such a case, the first coupling parts 1 are constructed not as runners, but as clamping parts, with the aid of which the holding elements 4 are clamped to the guide.

Figure 14:
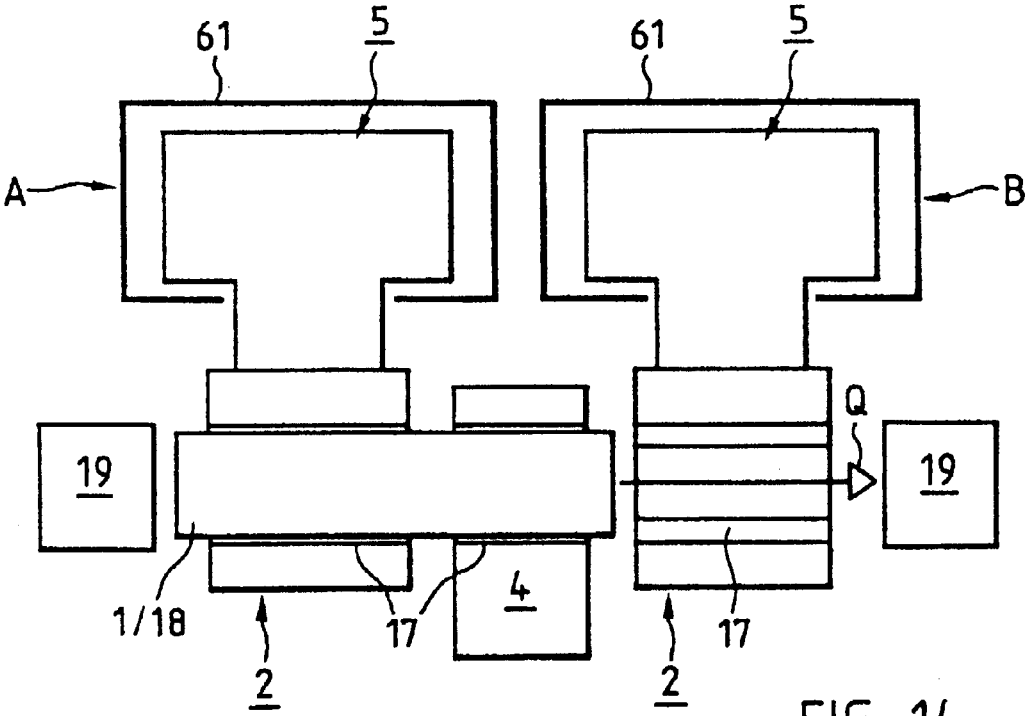
FIG. 14 shows a transfer area operated according to a further embodiment of the inventive method.

Once again showing a transfer area, FIG. 14 illustrates a third embodiment of the inventive method. Very diagrammatically two conveying paths A and B with guide channels 61 are shown and in the guide channels 61, as shown in greater detail in FIG. 4, conveying elements 5 move. The conveying elements comprise second coupling parts 2 having an opening 17 oriented at right angles to the conveying direction. The holding element 4 has an identical through hole 17. The first coupling part 1 is constituted by a bolt 18 with a cross-section matched to the opening 17 and being movable in said openings at right angles to the conveying direction (arrow Q). Depending on the sliding position of the bolt 18, the holding element is coupled to a conveying element 5 movable on the conveying path A or to a conveying element 5 movable on the conveying path B. The openings 17 may be replaced by correspondingly orientated, outwardly narrowing grooves.

If the bolt 18 is at least partly made from a magnetic material, it is possible to drive it in the Q-direction with the aid of e.g. correspondingly controllable electromagnets 19.

The embodiment of the inventive method according to FIG. 14, in which a first coupling part is displaced at right angles to the conveying direction, has a position between the embodiments according to FIGS. 1 and 11. The holding element 4 only has one, first coupling part 1 or bolt 18 (embodiment according to FIG. 1) but still, during transfer the holding element 4 is not moved transversely to the conveying direction (embodiment according to FIG. 11).

No detailed description of the drive and control means has been provided in the present specification of the method and arrangement according to the invention. However, such means are known to one skilled in the technology of conveying systems for conveying products without holding elements associated with the products. It is easily possible for the expert to adapt these means to the presently described method and arrangement.

What is claimed is:

1. A method for transferring of items from a first path to a second path, the first path and the second path disposed parallel to each other for at least some extent, the method practiced with respect to second coupling parts disposed along the first path and third coupling parts disposed along the second path, the items each held by a first coupling part, the method comprising the steps of:

attaching one of the first coupling parts to one of the second coupling parts, the one of the first coupling parts holding one of the items;

moving the second coupling parts, including the one of the second coupling parts, along the first path in a conveying direction;

moving the third coupling parts along the second path in the conveying direction;

synchronizing the one of the second coupling parts with one of the third coupling parts during the at least some extent;

during the synchronizing, continuing to move the second coupling parts and the third coupling parts in the conveying direction, and moving the one of the first coupling parts at right angles to the conveying direction from the one of the second coupling parts to the one of the third coupling parts;

whereby the one of the items is transferred from the first path to the second path.

2. The method of claim 1, repeated a multiplicity of times, whereby a multiplicity of the items are transferred from the first path to the second path.

3. A method for transferring items from a first path to a second path, the method practiced with respect to second coupling parts disposed along the first path and third coupling parts disposed along the second path, the items each held by a first coupling part, the first coupling parts each having a first attachment point and a second attachment point, the first and second attachment points spaced by a first distance, each of the second coupling parts having a third attachment point, each of the third coupling parts having a fourth attachment point, the first path and the second path disposed parallel to each other for at least some extent, the first and second path when disposed parallel to each other for the at least some extent having a spacing such that the spacing between third and fourth attachment points is substantially the first distance; the method comprising the steps of:

attaching the first attachment point of one of the first coupling parts to the third attachment point of one of the second coupling parts, the one of the first coupling parts holding one of the items;

moving the second coupling parts, including the one of the second coupling parts, along the first path in a conveying direction;

moving the third coupling parts along the second path in the conveying direction;

synchronizing the one of the second coupling parts with one of the third coupling parts during the at least some extent;

during the synchronizing, continuing to move the second coupling parts and the third coupling parts in the conveying direction, attaching the second attachment point of the one of the first coupling parts to the fourth attachment point of the one of the third coupling parts, and subsequently, detaching the first attachment point of the one of the first coupling parts from the third attachment point of the one of the second coupling parts, continuing to move the second coupling parts along the first path in the conveying direction;

continuing to move the third coupling parts along the second path in the conveying direction;

whereby the one of the items is transferred from the first path to the second path.

4. The method of claim 3, repeated a multiplicity of times, whereby a multiplicity of the items are transferred from the first path to the second path.

5. A method for transferring items from a first path to a second path, the method practiced with respect to a first guide and a second guide, the items each held by a holding element, each holding element comprising a first coupling part and a second coupling part, each first coupling part movable between first and second positions, each first coupling part when in said first position disposed to grip the first guide and when in said second position disposed to be free of the first guide, each second coupling part movable between first and second positions, each second coupling part when in said first position disposed to grip the second guide and when in said second position disposed to be free of the second guide, the first and second coupling parts spaced a first distance, the first guide and the second guide disposed parallel to each other for at least some extent, the first and second guides when disposed parallel to each other for the at least some extent having a spacing that is substantially the first distance; the method comprising the steps of:

gripping a one of the holding elements to the first guide by moving the first coupling part into the first position, the one of the holding elements holding one of the items;

moving the second coupling part of the one of the holding elements into the second position;

moving the holding element along the first guide in a conveying direction;

during the at least some extent, moving the second coupling part of the one of the holding elements into the first position, whereby the one of the holding elements is gripped to the second guide, and subsequently, moving the first coupling part of the one of the holding elements into the second position; and moving the holding element along the second guide in the conveying direction;

whereby the one of the items is transferred from the first path to the second path.

6. The method of claim 5, repeated a multiplicity of times, whereby a multiplicity of the items are transferred from the first path to the second path.

7. A method for transferring items from a first path to a second path, the method practiced with respect to second coupling parts disposed along the first path and third coupling parts disposed along the second path, the items each held by a first coupling part, the first coupling parts each having a first attachment point, each of the second coupling parts having a second attachment point, each of the third coupling parts having a third attachment point, the first path and the second path disposed parallel to each other for at least some extent, the method further practiced with respect to bolts, each bolt when disposed with a first attachment point of a first coupling part and a second attachment point of a second coupling part for coupling the first coupling part and the second coupling part; each bolt when disposed with a first attachment point of a first coupling part and a third attachment point of a third coupling part for coupling the first coupling part and the third coupling part; the method comprising the steps of:

attaching the first attachment point of one of the first coupling parts to the second attachment point of one of the second coupling parts by one of the bolts, the one of the first coupling parts holding one of the items;

moving the second coupling parts, including the one of the second coupling parts, along the first path in a conveying direction;

moving the third coupling parts along the second path in the conveying direction;

synchronizing the one of the second coupling parts with one of the third coupling parts during the at least some extent;

during the synchronizing, moving the one of the bolts so that the one of the bolts is no longer disposed with the first attachment point of the one of the first coupling parts and the second attachment point of the one of the second coupling parts, the one of the bolts disposed with a first attachment point of the one of the first coupling parts and the third attachment point of the one of the third coupling parts, whereby the one of the first coupling parts is no longer coupled with the one of the second coupling parts, and is coupled with the one of the third coupling parts;

continuing to move the second coupling parts along the first path in the conveying direction;

continuing to move the third coupling parts along the second path in the conveying direction;

whereby the one of the items is transferred from the first path to the second path.

8. The method of claim 7, repeated a multiplicity of times, whereby a multiplicity of the items are transferred from the first path to the second path.

9. A method for conveying a large number of printed products along first and second conveying paths, the method comprising:

providing for each conveying path a plurality of respective conveying elements each conveying element being movable along the respective conveying path and comprising a first coupling part, the first coupling part thus defining a respective conveying path therefor;

providing a plurality of holding elements, each holding element being designed for gripping one printed product and comprising a second coupling part cooperating with a first coupling part;

conveying holding elements being coupled to conveying elements, along the conveying paths, and transferring holding elements from conveying elements associated with the first conveying path to conveying elements associated with the second conveying path during continuous conveyance of the conveying elements through a transfer location through which transfer location the first coupling parts of conveying elements associated with the first and second conveying paths run in parallel and closely spaced;

wherein first and second coupling parts are designed in such a manner that coupling and uncoupling is effected by moving the second coupling part substantially laterally relative to the conveying path of the first coupling part and wherein the step of transferring comprises aligning the first coupling part of one conveying element associated with the first conveying path with the first coupling part of one conveying element associated with the second conveying path, and moving the holding element coupled to the one conveying element associated to the first conveying path laterally relative to the conveying paths to the conveying element associated with the second conveying path, and thereby coupling it to the conveying element associated with the second conveying path.

10. A method for conveying a large number of printed products along first and second conveying paths, the method comprising:

providing for each conveying path a plurality of respective conveying elements each conveying element being movable along the respective conveying path and comprising a first coupling part, the first coupling part thus defining a respective conveying path therefor;

providing a plurality of holding elements, each holding element being designed for gripping one printed product and comprising two second coupling parts cooperating each with one first coupling part;

conveying holding elements being coupled to conveying elements, along the conveying paths, and transferring holding elements from conveying elements associated with the first conveying path to conveying elements associated with the second conveying path during continuous conveyance of the conveying elements through a transfer location through which transfer location the first coupling parts of conveying elements associated with the first and second conveying paths run in parallel and closely spaced;

wherein the step of transferring comprises aligning the first coupling part of one conveying element associated with the first conveying path with the first coupling part of one conveying element associated with the second conveying path, and uncoupling one of the two second coupling parts of the holding element coupled to the one conveying element associated to the first conveying path after coupling the other one of the two second coupling parts of the holding element to the first coupling part of the one conveying element associated with the second conveying path.

11. A method for conveying a large number of printed products along first and second conveying paths, the method comprising:

providing for each conveying path a guide (or rail) member extending along each conveying path;

providing a plurality of holding elements, each holding element being designed for gripping one printed product and comprising two coupling parts being couplable each to one guide member;

conveying holding elements being coupled to one guide member along the conveying paths, and transferring holding elements from the guide member associated with the first conveying path to the guide member associated with the second conveying path during continuous conveyance of the conveying elements through a transfer location through which transfer location the guide members associated with the first and second conveying paths run in parallel;

wherein the step of transferring comprises uncoupling one of the two coupling parts of the holding element coupled to the guide member associated with the first conveying path after coupling the other one of the two coupling parts of the holding element to the guide member associated with the second conveying path.

12. A method for conveying a large number of printed products along first and second conveying paths, the method comprising:

providing for each conveying path a plurality of respective conveying elements each conveying element being movable along the respective conveying path and comprising a first coupling part, the first coupling part thus defining a respective conveying path therefore;

providing a plurality of holding elements, each holding element being designed for gripping one printed product and comprising two second coupling parts each being couplable to a first coupling part with the aid of a third coupling part;

conveying holding elements being coupled to conveying elements, along the conveying paths, and transferring holding elements from conveying elements associated with the first conveying path to conveying elements associated with the second conveying path during continuous conveyance of the conveying elements through a transfer location through which transfer location the first coupling parts of conveying elements associated with the first and second conveying paths run in parallel and closely spaced;

wherein first, second and third coupling parts are designed in such a manner that coupling and uncoupling is effected by moving the third coupling part substantially laterally relative to the conveying paths of the first coupling part, and wherein the step of transferring comprises aligning the first coupling part of one conveying element associated with the first conveying path with the first coupling part of one conveying element associated with the second conveying path, and moving the third coupling part coupling the holding element to the one conveying element associated to the first conveying path laterally relative to the conveying paths to the conveying element associated with the second conveying path, and thereby coupling the holding element to the conveying element associated with the second conveying path.

13. An apparatus for conveying a large number of printed products along first and second conveying paths, the apparatus comprising:

a plurality of conveying elements each conveying element being movable along the first or the second conveying path and comprising a first coupling part, a plurality of holding elements, each holding element being designed for gripping one printed product and comprising a second coupling part cooperating with a first coupling part, and a transfer location through which the first coupling parts of conveying elements associated with the first and second conveying paths run in parallel and closely spaced, wherein first and second coupling parts are designed in such a manner that coupling and uncoupling is effected by moving the second coupling part substantially laterally relative to the conveying path of the first coupling part, and wherein in the transfer location there are provided means for aligning the first coupling part of one conveying element associated with the first conveying path with the first coupling part of one conveying element associated with the second conveying path, and means for moving the holding element coupled to the one conveying element associated to the first conveying path laterally relative to the conveying paths to the conveying element associated with the second conveying path.

14. The apparatus according to claim 13 wherein the pair of first and second coupling parts is a groove narrowing towards the outside and a comb with a narrowed neck area, wherein groove and comb extend at right angles to the conveying paths.

15. An apparatus for conveying a large number of printed products along first and second conveying paths, the apparatus comprising:

a plurality of conveying elements each conveying element being movable along the first or second conveying path and comprising a first coupling part, a plurality of holding elements, each holding element being designed for gripping one printed product and comprising two second coupling parts cooperating each with one first coupling part, and a transfer location through which the first coupling parts of conveying elements associated with the first and second conveying paths run in parallel and closely spaced, wherein in the transfer location there are provided means for aligning the first coupling part of one conveying element associated with the first conveying path with the first coupling part of one conveying element associated with the second conveying path, and means for uncoupling one of the two second coupling parts of the holding element coupled to the one conveying element associated to the first conveying path after coupling the other one of the two second coupling parts of the holding element to the first coupling part of the one conveying element associated with the second conveying path.

16. The apparatus according to claim 15, wherein the second coupling parts are connecting pieces and the first coupling parts are coupling grippers.

17. An apparatus for conveying a large number of printed products along first and second conveying paths, the apparatus comprising:

a guide member extending along the first and second conveying paths, a plurality of holding elements, each holding element being designed for gripping one printed product and comprising two coupling parts being coupleable each to one of the guide members, and a transfer location through which the guide members associated with the first and second conveying paths run in parallel and closely spaced, wherein in the transfer location there are provided means for uncoupling one of the two coupling parts of the holding element coupled to the guide member associated with the first conveying path after coupling the other one of the two coupling parts of the holding element to the guide member associated with the second conveying path.

18. The apparatus according to claim 17, wherein the coupling parts of the conveying elements are two-part runners, the two-part runners being closeable around the guide member.

19. An apparatus for conveying a large number of printed products along first and second conveying paths, the apparatus comprising:

a plurality of conveying elements each conveying element being movable along the first or second conveying path and comprising a first coupling part, a plurality of holding elements, each holding element being designed for gripping one printed product and comprising two second coupling parts each being couplable to a first coupling part with the aid of a third coupling, and a transfer location through which the first coupling parts of conveying elements associated with the first and second conveying paths run in parallel and closely spaced, wherein first, second and third coupling parts are designed in such a manner that coupling and uncoupling is effected by moving the third coupling part substantially laterally relative to the conveying paths of the first coupling part, and wherein in the transfer location there are provided means for aligning the first coupling part of one conveying element associated with the first conveying path with the first coupling part of one conveying element associated with the second conveying path, and means for moving the third coupling part coupling the holding element to the one conveying element associated to the first conveying path laterally relative to the conveying paths to the conveying element associated with the second conveying path, and thereby coupling the holding element to the conveying element associated with the second conveying path.

20. The apparatus according to claim 19, wherein the third coupling part is a bolt moveable in a corresponding opening of the holding element and that the second coupling part has a corresponding opening or groove.

* * * * *